United States Patent [19]

Fiorenza, Sr. et al.

[11] 4,016,890

[45] Apr. 12, 1977

[54] POWER-DRIVEN FINGERNAIL FILE

[75] Inventors: Joseph J. Fiorenza, Sr., Fort Lauderdale, Fla.; Irving Kalikow, Swampscott, Mass.

[73] Assignee: Joseph J. Fiorenza, Oakland Park, Fla.

[22] Filed: Dec. 29, 1975

[21] Appl. No.: 644,614

[52] U.S. Cl. ..... 132/75.6

[51] Int. Cl.[2] ..... A45D 29/04

[58] Field of Search ..... 132/75.6, 73.6, 73

[56] References Cited

UNITED STATES PATENTS

| | | | |
|---|---|---|---|
| 3,613,696 | 10/1971 | Pawle | 132/73.6 |
| 3,801,782 | 3/1963 | Funk | 132/73.6 |
| 3,916,921 | 11/1975 | Pesola | 132/73.6 |

*Primary Examiner*—G.E. McNeill
*Attorney, Agent, or Firm*—Joseph Zallen

[57] ABSTRACT

The power-driven fingernail file comprises a hollow body held in one hand and containing a battery operated motor. A finger-actuating button switch on the exterior controls a rotatable abrading member driven by a motor. The abrading member is located in an outer recess between a pair of upwardly curved bottom walls.

4 Claims, 4 Drawing Figures

POWER-DRIVEN FINGERNAIL FILE

BACKGROUND OF INVENTION

This invention relates to a power driven fingernail file. In particular it relates to a portable, battery-powered fingernail file.

Power-driven devices for the filing of fingernails have been described in the past. Thus, U.S. Pat. No. 1,831,327 describes a reciprocating shaft unto which are mounted elongated files or buffering devices. U.S. Pat. No. 1,848,864 provides a manicuring mechanism in the form of an abrading wheel. U.S. Pat. No. 2,056,379 provides a spindle carrying a rotary file or buffer on its end. U.S. Pat. No. 2,239,870 provides a reciprocating file which is accessible through a slot. U.S. Pat. No. 2,880,737 describes a manicuring tool which provides oscillation of an emery board. U.S. Pat. No. 3,311,117 describes a power-driven manicuring device which includes a ring-shaped abrasive disk surrounding a depressable spring-backed control plunger. However each of these prior art devices is characterized by one or more disadvantages such as bulkiness, high cost, excessive power, awkwardness or the necessity for skill.

One object of the present invention is to provide a portable, power-driven fingernail file which is compact, inexpensive, requires low power and is safe and easy to use.

Other objects and advantages of this invention will be apparent from the description and claims which follow taken together with the appended drawings.

SUMMARY OF INVENTION

The portable, power-driven fingernail file of this invention comprises generally a hollow body portion adapted to be held in one hand, a battery-operated motor housed within the body, a finger-actuating button switch on the exterior of the body, for operating said motor, and a rotatable abrading member driven by the motor and located in an outer recess provided in the body. The recess is formed by rear and side walls and a pair of upwardly curved bottom walls separated by a space in which the abrading member is positioned.

In operation, the user holds the unit in one hand so as to be able to depress the button switch with his thumb and places the desired fingernail of the other hand on the abrading member so that the nail rests on the curved walls in contact with the abrading member while the flesh part of the finger is below the curved walls, the curved walls acting as a positioning guide and guard.

The motor used need not be of high torque since the abrading member is close to the motor. Thus for example a motor intended to be driven by two AA dry cells would be satisfactory as for example an Edmund Motor P-41965.

The body is preferably generally flat or clam-shell in shape and compact in dimensions, as for example 3 × 2⅓ × 1 inches, with a recess width of about ¾ inches. A typical size of an abrasive member would be ¼ of an inch. It is preferred that the abrasive members be replaceably mounted on the motor shaft and when mounted be close to the motor itself. The switch is preferably near the top of the recess.

Because of the light weight and small flat shape it is easily manipulable so as to provide the user with the desired amount of grinding action and pressure in an easily controlled and safe manner wherein the flesh of the finger is protected.

SPECIFIC EXAMPLE OF INVENTION

Figure 1:
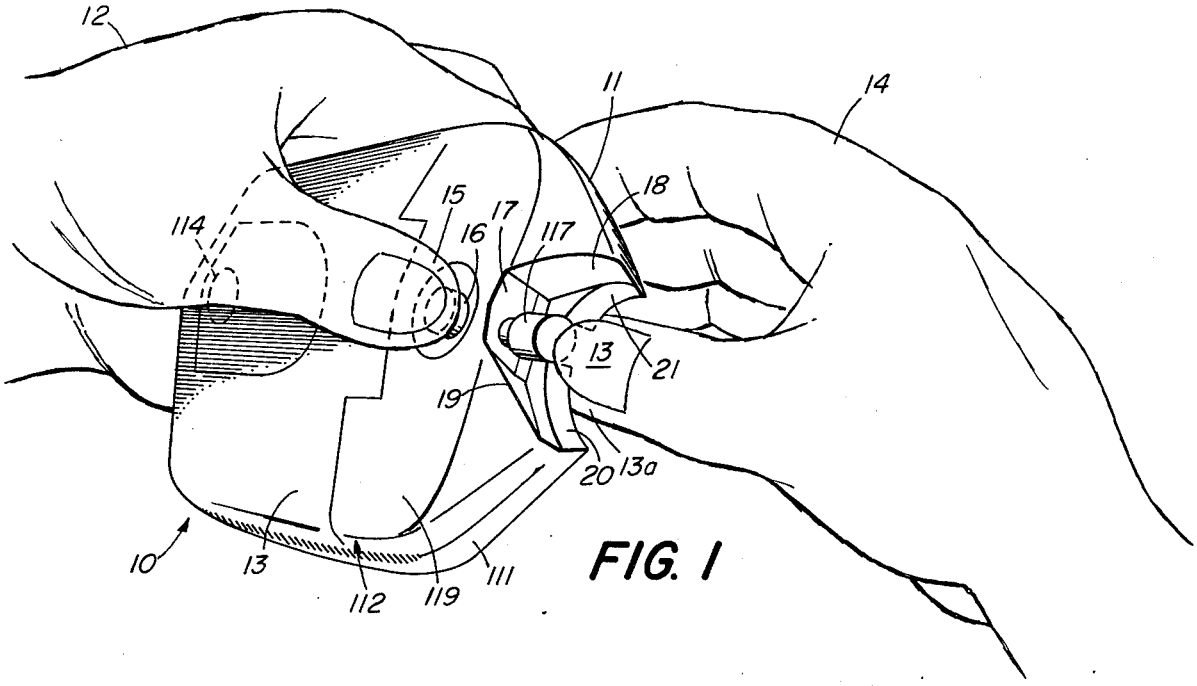
FIG. 1 is a perspective view of one embodiment of this invention as operated by a person holding the device in one hand and filing a fingernail of the other hand.
Figure 2:
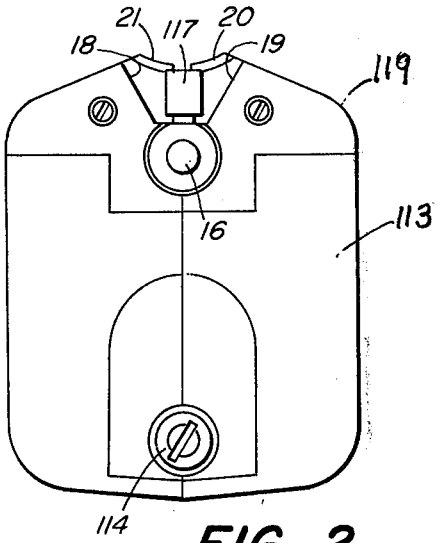
FIG. 2 is a top view of the device illustrated in FIG. 1.
Figure 3:
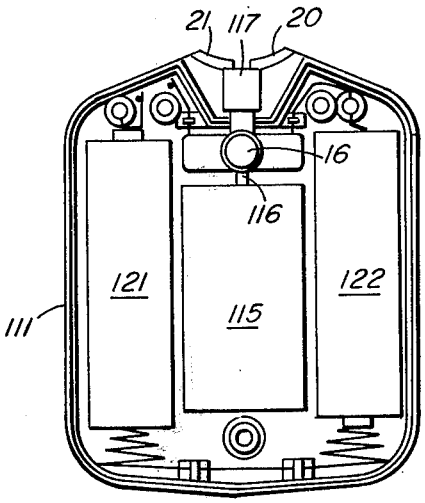
FIG. 3 is a top view with battery cover and switch cover removed.
Figure 4:
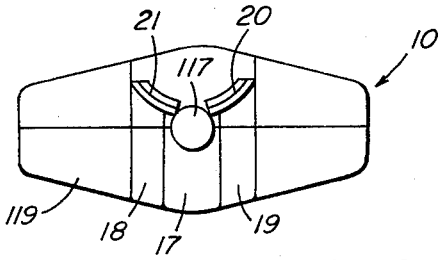
FIG. 4 is an end view.

Referring now to the drawings, there is illustrated therein an embodiment 10 of the present invention. The illustrated example has a flat, clam-like body 11 adapted to be held in one hand 12 for filing the nail 13 of the other hand 14. The thumb 15 of hand 12 can be used to actuate the switch 16.

The front of body 11 has a recess formed by a rear wall 17 side walls 18 and 19 and two upwardly curved bottom wall sections 20 and 21. Spaced between the lower wall sections 20 and 21 is the rotatable abrading member 22. The fingernail 13 rests upon the lower wall sections 20 and 21 so that the fleshy portion of the finger 13A is below the wall portions while the fingernail 13 itself is above and in selected contact with the rotatable abrading member 117.

The body 11 has upper and lower shells 111 and 112 with shell 112 having a switch cover 119 and battery cover 113. The two shell sections are held together by a threaded member 114.

The motor 115 has a shaft 116 engageable with replaceable abrading member 117 having a crimpable extension 118 which is engageable with the motor shaft 116. A portion of the shell 112 comprises a switch cover 119 through which a button switch 116 protrudes which has actuation surface to feed current from AA batteries 121 and 122 to the motor 115. The switch is preferably spring-back so that release of pressure will disengage the switch.

While the illustrated example describes the use of dry cells, a nickel cadmium rechargeable cell with a charging plug connector can be used in place of the dry cell.

I claim:

1. A portable, power-driven fingernail file which comprises a hollow body adapted to be held in one hand, a motor housed within the body and actuated by means of a switch on the exterior of the body, an outer recess in the body formed in part by a pair of spaced-apart upwardly curved bottom walls and an abrading member positioned between said curved bottom walls and rotated by said motor.

2. The power-driven fingernail file of claim 1 wherein the body is generally flat in shape and the switch is positioned close to said recess.

3. The power-driven fingernail file of claim 1 wherein the switch is actuable by a finger of the hand holding the device.

4. The power-driven fingernail file of claim 1 wherein the motor is powered by a battery housed within the body.

* * * * *